United States Patent [19]

Leone

[11] Patent Number: 4,744,694

[45] Date of Patent: May 17, 1988

[54] METHOD AND APPARATUS FOR TEXTURING BRIDGE DECKS AND THE LIKE

[76] Inventor: John Leone, 635 Hopkins Rd., Amherst, N.Y. 14221

[21] Appl. No.: 9,730

[22] Filed: Feb. 2, 1987

[51] Int. Cl.[4] ..... E01C 23/02

[52] U.S. Cl. ..... 404/89

[58] Field of Search ..... 404/74, 75, 87, 89; 299/36–38; 425/456, 458

[56] References Cited

U.S. PATENT DOCUMENTS

| | | | |
|---|---|---|---|
| 1,683,292 | 9/1928 | Heltzel | 404/74 |
| 2,617,336 | 11/1952 | Brickler | 404/89 |
| 3,516,339 | 6/1970 | Perkins | 404/75 |
| 3,516,340 | 6/1970 | Perkins | 404/75 |
| 3,801,211 | 4/1974 | Perkins | 404/89 X |
| 3,874,806 | 4/1975 | Grist et al. | 404/75 X |
| 4,070,128 | 1/1978 | Garrison | 404/89 |
| 4,371,330 | 2/1983 | Hefferman | 425/458 |

OTHER PUBLICATIONS

Bid-Well Workbridge Texturing Kit brochure, Feb. 1984.

Brochure-"Bidwell Automatic Roller Finisher" 4 pages, May 1971.

*Primary Examiner*—Stephen J. Novosad
*Assistant Examiner*—John F. Letchford
*Attorney, Agent, or Firm*—Bernard A. Chiama

[57] ABSTRACT

An apparatus for producing grooves in plastic concrete bridge decks and the like having a cutter bar supporting a plurality of parallel cutter blades adapted to be embedded in the surface of a deck and a driving mechanism for imparting reciprocal movement of the blades transversely across the deck. The cutter bar is pivotally mounted on a carriage to permit the cutter bar to conform to the surface of the deck.

1 Claim, 6 Drawing Sheets

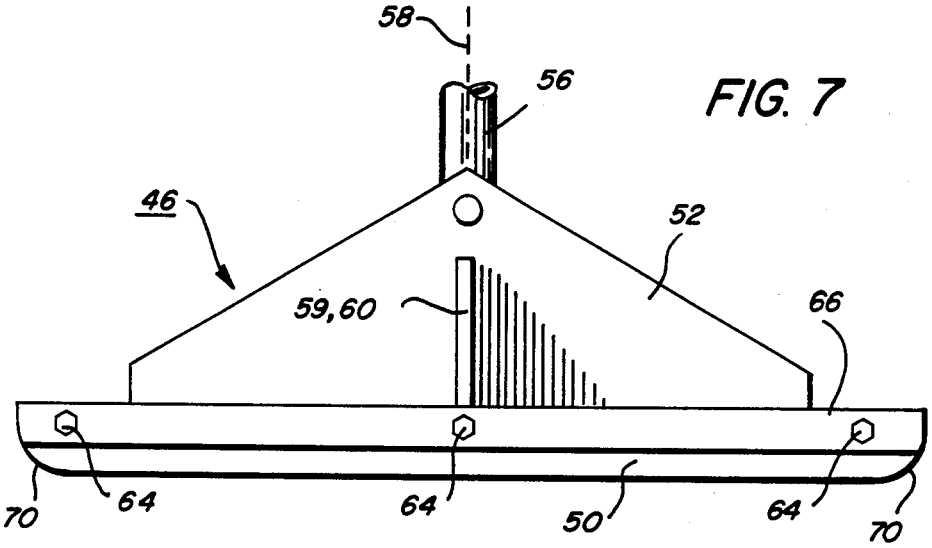
FIG. 7
FIG. 8
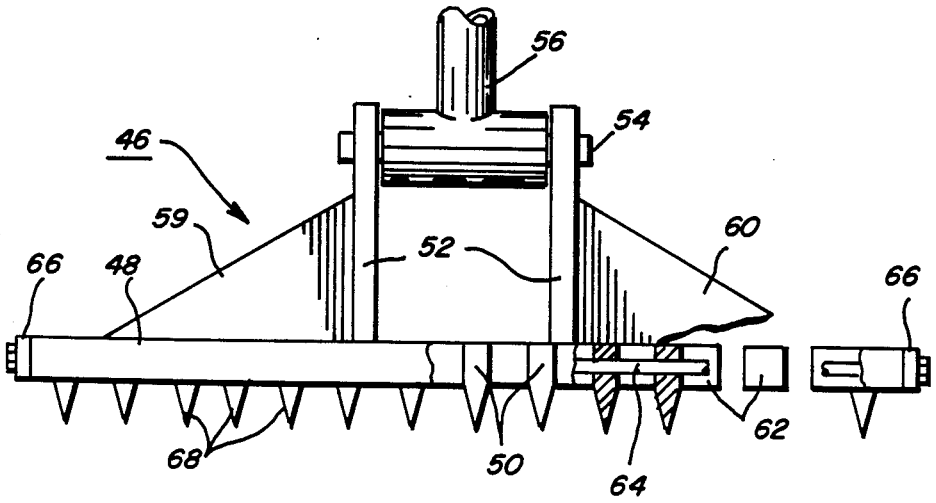

METHOD AND APPARATUS FOR TEXTURING BRIDGE DECKS AND THE LIKE

The present invention is directed to a method and apparatus for producing transverse grooves in concrete bridge decks associated with highway surfaces, and to airport runways, or sections thereof.

In the building of the more recent highway bridges, concrete bridge decks, or those one or more large segments of the bridge surfaces which go to make the road surface of the bridge, are provided with transverse grooves in order to prevent vehicle skidding under icing conditions or during heavy rain. Transverse orientation of grooves is preferred over longitudinal grooves for bridge surfaces because transverse grooves provide better surface gripping action and do not produce the vehicle swaying motion that is generally caused by longitudinal grooves.

Therefore, since the conventional methods and apparatus for producing transverse groovings require relatively high costs as compared to producing longitudinal grooving, the latter has been used mainly for long stretches of curved highway, whereas the former has been used for bridge decks which involve smaller areas, and because the safety factor for driving on bridges is much greater.

Since bridge surfaces are crowned, water produced either by momentary melting of snow or ice, or by heavy rainfall, is conducted by the transverse grooves from the center high portions of the bridge to the side portion thereof. However, present day conventional transverse grooves are formed and shaped in a manner which produces rapid deterioration of the once efficiently effective grooves and the lessening of their gripping action. In addition, as stated above, the cost of producing present day transverse grooving is very high and the methods are time consuming.

Conventional methods of producing transverse grooves on concrete bridge decks involve the steps of finishing the concrete applied thereto while in a plastic condition to a uniformly smooth, dense, even surface and texturing the surface in a transverse direction. Texturing is performed with an artificial turf drag made of molded polyethelene with synthetic turf blades approximately 0.50 inches in length and having a density of approximately 6000 blades per square foot. The finishing movement and resulting progress of the turf drag is preformed in such a manner as to prevent ridges and gouges forming in the concrete surface. The texturing step is stopped a short distance, generally one foot or so, from the curbing or railing associated with the bridge After a minimum of 14 days after the initial texturing, or at least until the concrete slab comprising the bridge deck is set, the deck is subjected to sawcutting grooves into the surface of the slab. Multi-bladed saw cutting equipment, using circular blades, cuts the concrete surface perpendicular or radial to the center line of the bridge to produce grooves rectangular in shape and conforming to the approximate dimensions: width—0.1 inch, depth—$\frac{1}{4}$ inch, and spaced $\frac{3}{4}$ inch center to center.

The current grooving method also requires disposing properly the resultant slurry or debris from the grooving/sawing operation. Furthermore, in disposing of such slurry or debris, care must be taken to prevent this material from entering any watercourse, stream, storm or sanitary waste system. In the current grooving method, the plastic concrete is initially cured after the application of the turf drag and subsequently cured again after the saw cutting/grooving operation.

In addition to the disadvantages of requiring many operative steps to accomplish, one of which, saw cutting/grooving, is very time consuming with consequent loss of time during which the bridge deck may not be used for traffic, is the relatively rapid deterioration the resultant deck entails. Since the finished grooves do not terminate at the curbing for the bridge, water accumulates from the lower ends of the grooves to some distance toward the center line, which distance may be substantial for bridges having a flat or low-crown configuration. In freezing weather, the collected water freezes, and since the grooves are rectangular in cross-section, the resulting expanding ice produces cracking of the concrete corners bordering the grooves thereby pulverizing these portions of the concrete deck. Eventually, the corners adjacent the grooves become rounded and lose their effect in preventing skidding of vehicles as they travel across the bridge.

Therefore, it is the principal object of the present invention to produce transverse grooving of the bridge decks and airport runways in the shortest possible time and requiring steps and apparatus which are simple and economical to perform and utilize.

It is another object of the invention to produce transverse grooving in bridge decks which will withstand extreme weather conditions and provide many more years of efficient service.

The objects of the invention are accomplished by a method which requires forming transverse grooves while concrete is in the plastic state. A grooving apparatus is devised which forms the grooves from bridge curbing to curbing thereby preventing the accumulation of water at the terminal ends of the grooves. The apparatus is provided with one or more cutter bars, each including a plurality of elongated cutter blades arranged in parallel and spaced from each other by spacers which may assume different widths. The cutting edges of the blades are tapered to produce grooves in the plastic concrete having a triangular configuration as the blades are moved in a direction along their longitudinal axes.

The one or more cutter bars are mounted on a carriage arranged for movement transverse to the longitudinal axis of the bridge deck. The carriage in turn is movably mounted on a conventional concrete paving machine which is propelled longitudinally along the bridge on rails arranged on the sides thereof. Movement of the carriage is made available by the use of rails mounted on the paving machine and arranged so that the carriage can be propelled transversely of the machine, or from one side of the bridge to the other and return.

In operation, the carriage is propelled from one side of the bridge to the other while the paving machine is held stationary to produce a first series of grooves. The paving machine is then moved longitudinally a distance equal to the length of the carriage and the carriage is driven back to its initial position to produce a second series of grooves, and the process is repeated in a stop and repeat progression method.

In addition to the art described above, U.S. Pat. No. 3,516,339 discloses a grooving method and apparatus for producing conventional longitudinal grooves in a road. Molding bars are provided having tapered forming edges, the bars being spaced transversely so as to produce the longitudinal grooves. Since the grooves are oriented longitudinally, the problem of deteriorating groove edges is not addressed as is the case for transverse oriented grooves formed in bridge decks.

In U.S. Pat. No. 1,683,292, a method and apparatus is disclosed for forming joint and traffic grooves which are filled with a sealing joint material. Various shapes of grooves are disclosed including V-shapes. However, regardless of the shape, which is of no concern to the patentee relative to the effect of collecting water, the grooves are filled with material which renders the same of no value to the prevention of skidding.

In U.S. Pat. No. 4,371,330, a screed bar carrying one or more sled runners is disclosed for use in passing through the surface of plastic concrete. The runners are thin so that concrete may flow back into grooves after formation.

Other objects and advantages will become apparent from the following description taken in conjunction with the accompanying drawings wherein:

FIGS. 1(*a*) and 1(*b*) are schematic, cross-sectional views of a portion of a concrete bridge deck showing grooves formed by conventional methods;

FIGS. 1(*c*) and 1(*d*) are schematic, elevational views of the grooves of FIGS. 1(*a*) and 1(*b*);

FIG. 7 is an elevational view of the cutter bar;

FIG. 8 is an end view of the cutter bar;

Figure 1A:
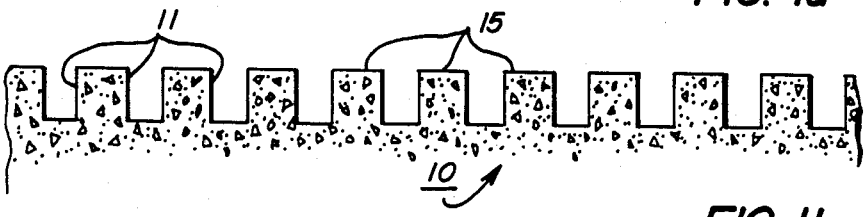
Figure 1B:
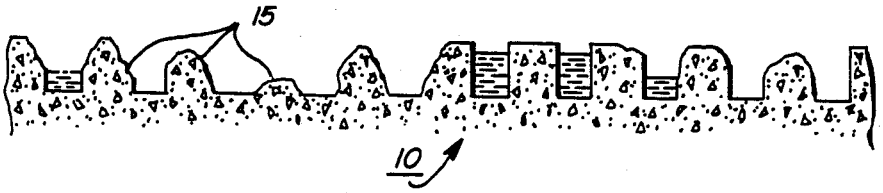
Figure 1C:
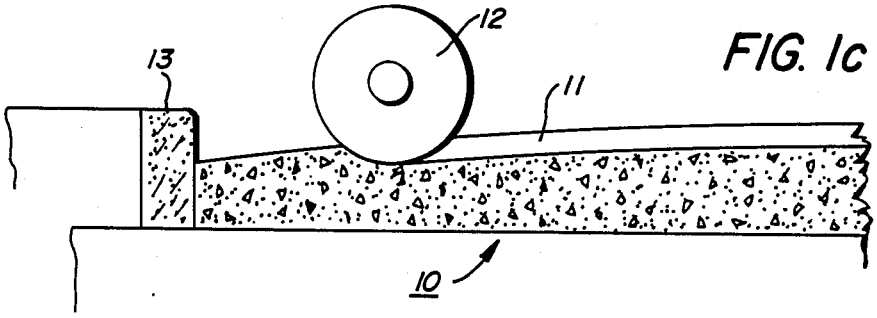
Figure 1D:
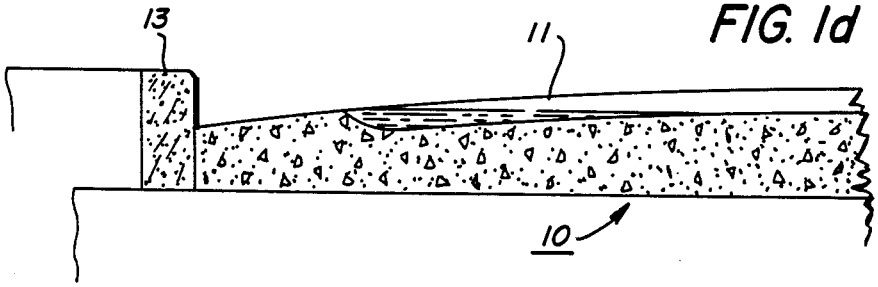

The formation of transverse grooves in a concrete bridge deck 10 by the conventional methods results in grooves 11 having rectangular shapes as shown in FIG. 1(*a*). The grooves are cut into the surface of the concrete deck surface by a multitude of rotary cutting blades 12, as shown in FIG. 1(*c*) after concrete is laid and allowed to cure, generally about one to two weeks after pouring. The ends of the resultant grooves 11 generally terminate a relatively substantial distance from the curbing 13 of the bridge.

The rectangular shapes of the grooves 11 and the undue spacing between their ends relative to curbing or other means to incur drainage because of the surface cutting devices and equipment therefor, results in the high accumulation of water in the grooves during melting of snow or heavy rainfall, as shown in FIG. 1(*d*). The accumulation of water is further compounded by the presence or buildup of dirt at the lower or terminal ends of the grooves.

Repeated and/or constant freezing of the accumulated water in the grooves expands to cause deterioration of the concrete ridges 15 between the grooves 11. Such deterioration in time may effect complete or near complete destruction of the ridges in the worst situation, or to produce the rounding of the ridges at the corners thereof. In either situation, besides contributing to the structural weakness of the bridge, the destruction or rounding of the ridges will lessen or eliminate the use of the grooving for preventing vehicle skidding.

In the present invention of a method and apparatus, the transverse grooves 18, as shown in FIG. 1(*d*), have a triangular cross-sectional shape which is formed with terminal ends at or adjacent the curbing for a bridge. These formational shapes minimize the volume of water which may accumulate in the bottoms of the grooves and provide expansion space for freezing water in the event residual water remains in the grooves.

Figure 3:
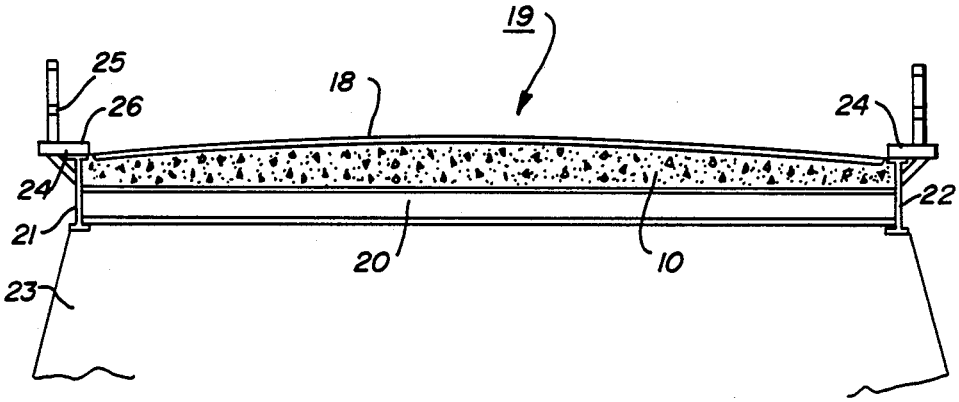
FIG. 3 is a schematic view of a bridge deck showing a groove made in accordance with the present invention.

In FIG. 3 there is shown a typical bridge 19 in cross-section and which includes the concrete bridge deck 10 supported by a bed structure 20 between side I-beams 21, 22 which, in turn, rest upon concrete support abutments 23. The typical bridge 19 will also include a form of curbing 24 and a railing 25 as part of its basic construction. Other structural arrangements may be used and others added; such, for example, the curbing 24 may be extended in width to provide a sidewalk 26, or may be eliminated entirely.

Figure 4:
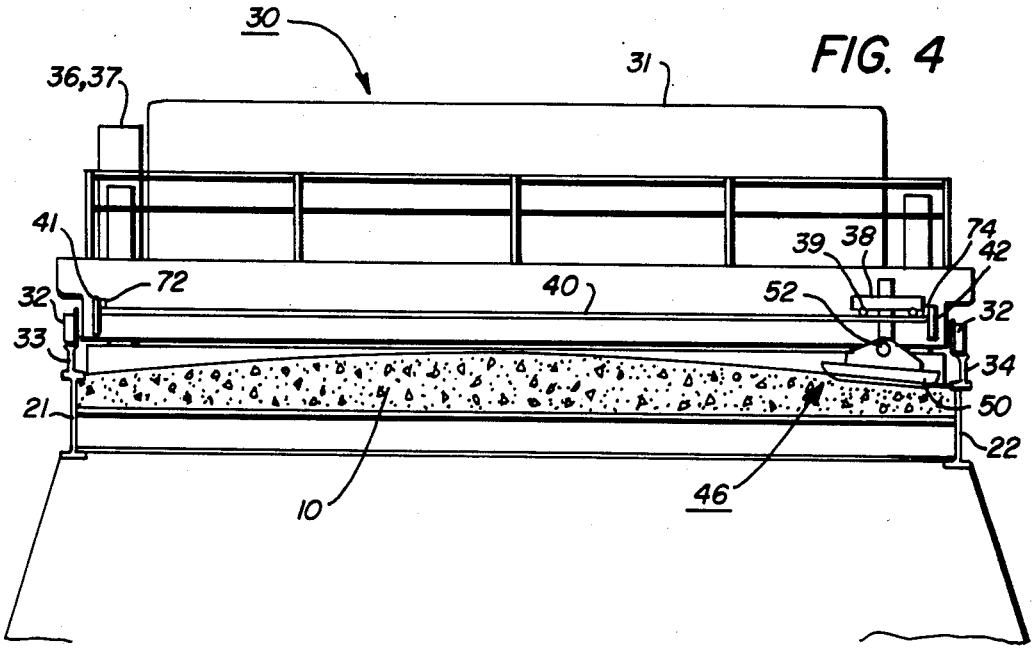
FIG. 4 is a schematic view of a paving machine utilized in the present invention shown in operating position.
Figure 6:
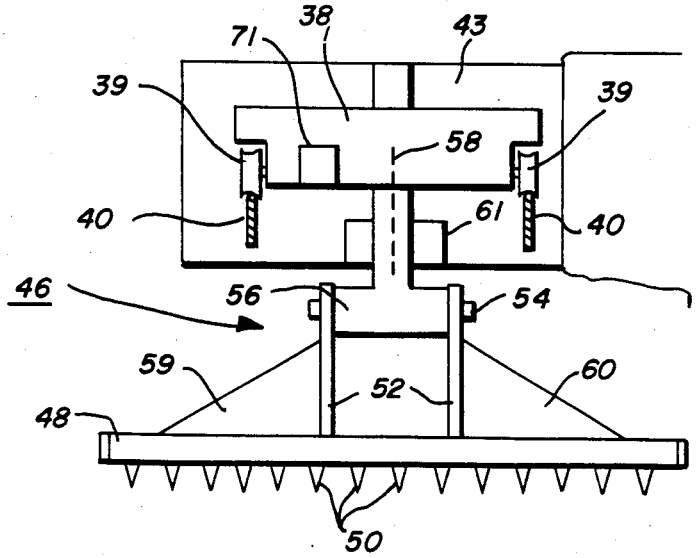
FIG. 6 is a schematic view of the carriage and cutter bar of the present invention.

In FIG. 4, the apparatus utilized with the present invention, generally indicated at 30, is shown placed upon the bridge 19 in its unfinished condition during operation of the apparatus. The apparatus, or paving machine 30, includes the conventional concrete laying arrangement having a large hopper or slip form 31 which is adapted to receive repeatedly fresh concrete from trucks and to continuously lay the concrete between side forms comprising the I-beams 21, 22, or other conventional forms to contain the concrete deck mass.

In this operation, the machine 30 includes a plurality of wheels 32 for supporting the same for longitudinal rolling along the bridge during laying of the bridge deck 10. The wheels 32 are supported for this operation upon longitudinally placed, parallel spaced rails 33, 34 supported on the I-beams 21, 22, respectively.

The paving machine 30 is also provided with other devices incidental to the paving of concrete decks, such for example, a motor drive system generally in the form of a gasoline or diesel engine 36 and a clutch mechanism 37 for moving the paving machine along the rails 33, 34 during paving operations. Other devices include a scrapper device arranged to form a crowned mass of concrete, vibration means for densifying the mass and a metering apparatus for smoothing the mass to its final dimensions.

In operation of the machine 30, the slip form 31 repeatedly receives deposits of plastic concrete from standby concrete mixing trucks while the machine is slowly moved along the bridge. During this movement, concrete flows from the lower extrusion device for the machine to begin the formation of the concrete mass for the deck 10 and the other devices incidental to the paving operation are employed to finish the treatment of the concrete. This slip forming operation is made continuous, that is, concrete batches are repeatedly deposited in the paving machine as by a suitable fleet of concrete mixing trucks while the machine continues to pour concrete at the speed suitable for the operation.

In the present invention, this operation is modified to replace the continuous movement of the paving machine with a stop-and-go procedure. The paving machine 30 is moved a predetermined distance and stopped for a time period necessary to accomplish grooving in the surface of the newly laid and finished concrete, whereupon movement is resumed. This movement of the machine a predetermined distance, stopping and resumption of movement, continues as a stop-and-go operation.

Figure 5:
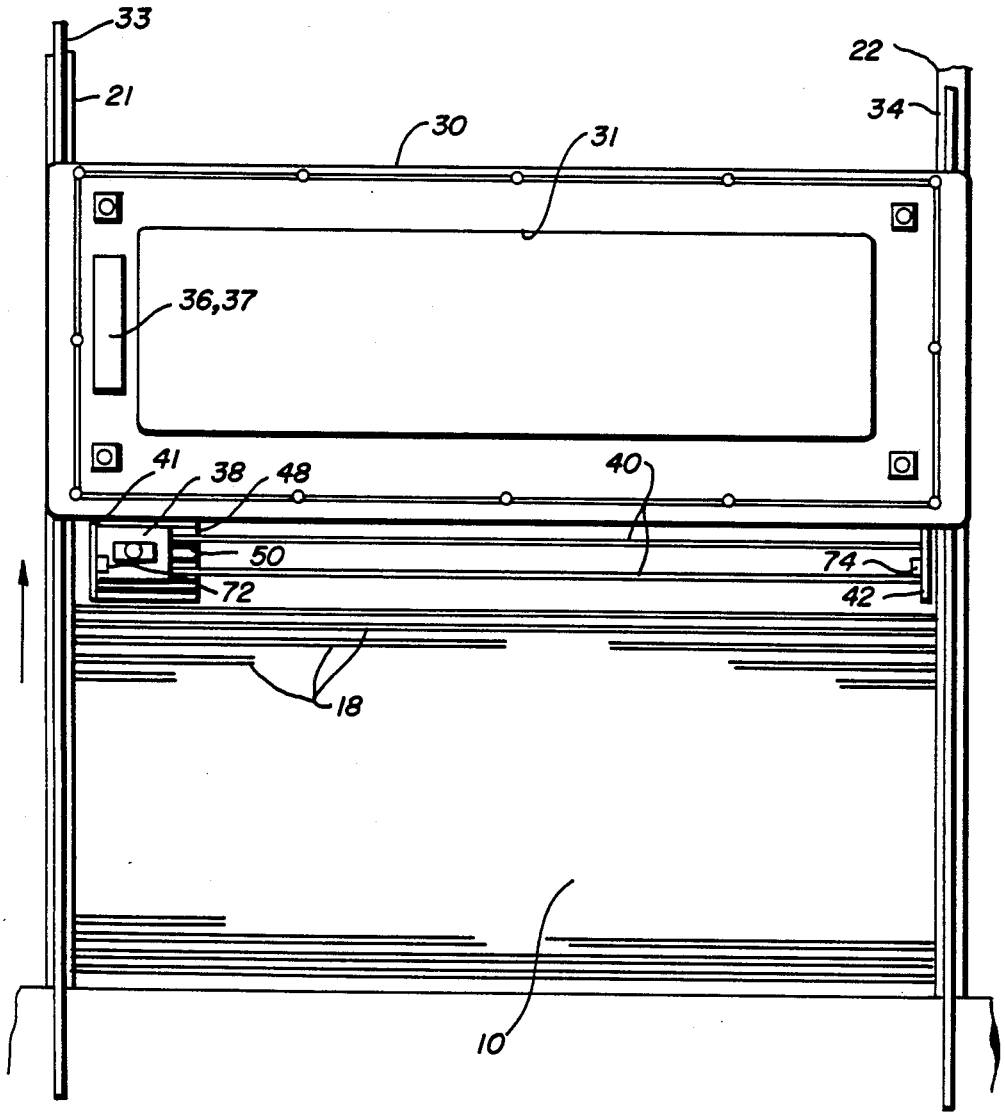
FIG. 5 is a plan view of the machine in FIG. 4.
Figure 9:
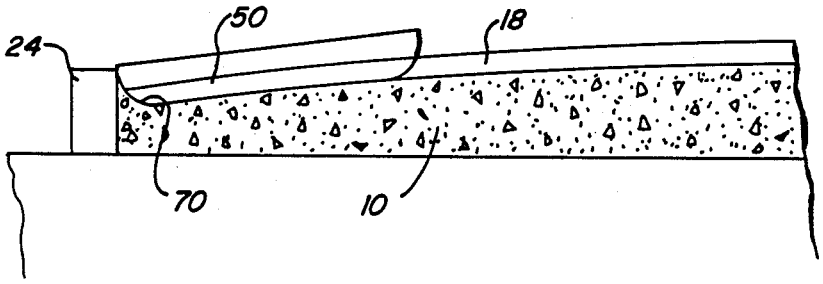
FIG. 9 is a partial schematic view of a bridge deck with a cutter blade of the present invention applied thereto and a finished groove.

Grooving is achieved by use of a carriage 38 mounted on the frame for the machine 30 for reciprocal movement from side to side thereof transverse to the bridge deck 10. As shown in FIGS. 4 and 5, the carriage includes wheels 39 supported on parallel rails 40, mounted on side supports 41, 42 of the machine 30 aft thereof. With the carriage 38 located aft of the machine 30, grooving is effected after the concrete is poured by the machine 10 and is in finished condition for eventual curing. The length of the rails 40 may be extended as is necessary for different widths of the bridge deck 10 by suitable extensions. This may be accomplished by varying the distance between the supports 41, 42 on the machine 30.

The carriage 38 serves to support a grooving apparatus 46 comprising a cutter bar assembly 48 formed by a plurality of elongated cutter blades 50 arranged in close parallel relationship. The cutter bar 48 is mounted on and depends from a pair of spaced vertically oriented parallel plates 52 pivotally supported by a horizontal pivot pin 54 to a T-shaped frame 50 which, in turn, is mounted to the carriage 38 for pivotal rotation about a vertical axis 58. To add strength to the apparatus 46, side plates 59, 60 are secured to the plates 52 and serve to support the bar assembly 48 against movement relative to the plates 52. This arrangement orients the blades 50 with their longitudinal axes in alignment with the direction of the transverse movement of the carriage 38.

The cutter bar 48 is adapted for limited rocking or pivotal movement about two axes: one defined by the axis of the pivot pin 54, and the other about the axis 58, thereby allowing the blades 50 to assume the contour of the surface of the bridge deck during the grooving operation. A drive mechanism 61 is mounted on the carriage 38 and operatively connected to the frame 58 for lowering and raising the cutter bar 48 and, consequently, the blades 50.

The bar assembly 48 comprises the blades 50, a spacer 62 therebetween and two or more screw fasteners 64 projecting through suitable openings formed in the blades and the spacers. A retaining strip 66 is positioned at each of opposite sides of the assembly 48 through which the fasteners 64 project. These strips serve to hold the bar assembly 48 in its assembled condition ready for the grooving operation. When assembled with a large number of blades 50, as shown in FIGS. 5 and 8, the bar 48 is generally rectangular in the plan view.

Figure 2:
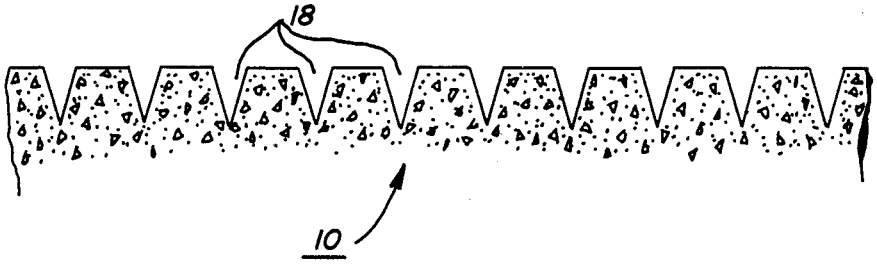
FIG. 2 is a schematic cross-sectional view of a portion of a concrete bridge deck formed in accordance with the present invention.

Each of the blades 50 has a tapered forming edge 68 which is adapted to penetrate the surface of plastic concrete in a bridge deck to form the tapered grooves 18, as shown in FIG. 2. The depth of grooving can be determined by the distance each of the tips of the edges 68 extends below the lower surfaces of the spaces 62 when the cutter bar assembly 48 is placed upon the surface of the bridge deck. When so placed, and as the assembly is driven across the deck during the grooving operation, the spacers define the lower limit to which the assembly will protrude into the plastic concrete. It will be apparent, then, that the proper depth for the grooving 18, a depth which optimizes the function for transverse grooving, will be made available by a corresponding choice of size lengths of the edges 68.

As shown in FIG. 7, the ends of each of the blades 50 are formed with curved sections 70 which cut into the plastic concrete in advance of the main groove-forming edges of the blades. This positioning of the blades 50, the structure thereof, and the cutter bar 48 insures that the grooves 18 are formed as close as possible to the curbing 24. Such closeness is not possible with the use of rotary cutter blades 12 because of their large form, but mostly because of the structural support for these blades. Consequently, the ends of the grooves 18 produced in accordance with the present invention substantially reduce the accumulation of water and water/ice slush at the lower ends of transverse grooves thereby minimizing or eliminating the amount of ice which may accumulate in these grooves.

Figure 10:
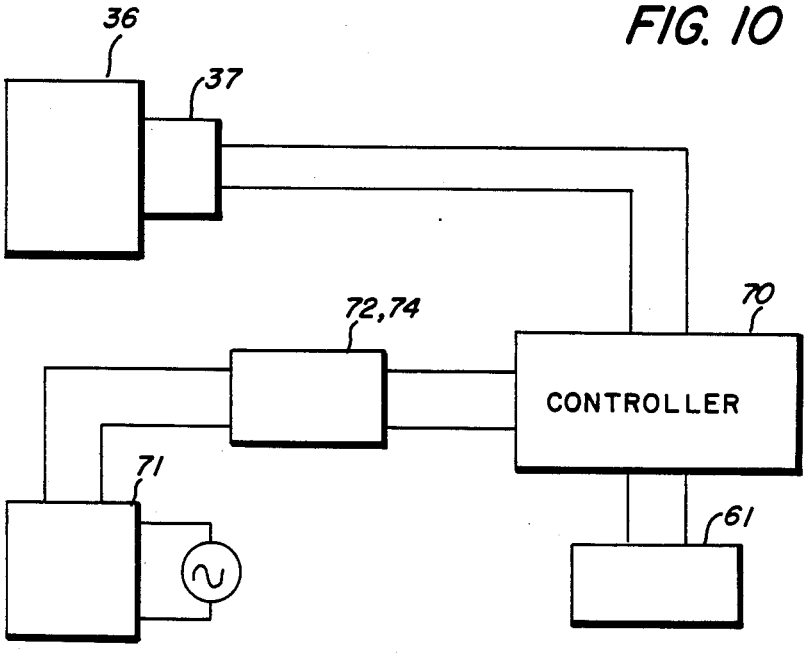
FIG. 10 is a schematic diagram of a control system arranged to provide full automatic control to the present invention.

Operation of the carriage 38 in automatic and continuous reciprocal movement is achieved by a control system having a controller 70 devised for controlling various electrical or hydraulic components as shown in FIG. 10.

The control system includes an electrical or hydraulic drive system 71 mounted on the carriage 38 and switch mechanisms 72, 74 positioned on the supports 41, 42, respectively. The switch mechanisms 72, 74 are arranged for contact with the carriage 38 and activation thereof when the carriage reaches the respective support. As the carriage 38 is driven by the drive 70 to the left, as viewed in FIG. 4, the cutter bar assembly 46 is dragged on top of and across the surface of the plastic concrete deck 10 whereby the blades 50 form the grooves 18. The number of grooves so formed are determined by the number of blades 50 which make up the assembly 46.

When the carriage 38 reaches the support 41, the switch 72 is actuated to open the circuit to the electrical or hydraulic drive 71 and terminate further movement of the carriage. Immediately thereafter, the drive mechanism 61 is energized for a time sufficient to raise the cutter bar assembly 48 out of contact with the deck 10. Upon this occurrence, the clutch mechanism 37 associated with the drive engine 36 for the paving apparatus is activated to initiate movement of the paving machine and effect laying of additional concrete along the deck 10. The distance of this movement of the machine 30 is arranged to correspond with the width of the bar assembly 48 and is preset in the controller 70 to this effect.

After the paving machine 30 is moved the distance corresponding to the width of the bar assembly 48, the clutch mechanism 37 is activated to stop movement of the paving machine 30, and the drive mechanism 61 is activated to lower the bar assembly upon the surface of the plastic concrete of the deck 10 and permit depressing of the blades 50 into a new section of plastic concrete just previously laid by the machine 30. The motor for the drive system 70 for the carriage 38 is again energized to drive the carriage in the reverse direction or to the right as viewed in FIGS. 4 and 5. This movement of the carriage produces another series of grooves 18 in the plastic concrete of the deck 10.

Upon reaching the support 42, the carriage 38 engages the switch mechanism 74 thereby opening the circuit to the electrical or hydraulic drive 71 to terminate further movement of the carriage and formation of the grooves 18. At the same instant, the drive 61 is activated to raise the cutter bar assembly 48 from the deck 10.

The controller 70 is adapted to continue the aforementioned automatic operation of the machine 30 by sequential operation of the various drives 36, 61 and 71. In this operation, the cutter bar assembly 48 is reciprocally moved across the plastic concrete of the deck 10 forming side-by-side series of grooves 18 transverse to the longitudinal axis of the bridge deck. By virtue of the structure of the cutter bar and the blades 50, the ends of the grooves extend to the curbing 24 and thereby permit the escape of water and ice/slush from the bridge deck proper during heavy rains or after melting of snow and ice.

While the present invention has been described and illustrated in an arrangement which is fully automatic with the paving of a bridge deck so that transverse grooving is accomplished during the paving operation, the invention may be practiced separately from the paving operation, and at a later time. For example, the paving machine 30 may be set in operation in the conventional non-stop manner to function solely for paving the deck 10. At some later time, while the concrete is still plastic, the machine may be brought back to its starting position to repeat the trip along the bridge deck. During this second trip, only the grooving function using the drives 61 and 71, as described above, is utilized.

In still another arrangement of operation, in its most simple form, the carriage 38 may be moved manually in one or both directions to effect grooving. Rather than forming a part of the conventional paving machine 30, the rails 40, carriage 38, drive 71 and other related structures may be incorporated into a separate supporting vehicle arranged to travel along the rails 33, 34. The various drives 36, 61 and 71 may also assume other forms than those mentioned above. For example, the engine 36 may take the form of an electrical motor or a power plant comprising an engine, generator, motor combination. One or more of the drives may also operate pneumatically or hydraulically to effect its purpose.

The foregoing description of the invention has been particularly applied to the grooving of a bridge deck. The invention is also applicable to airport runways or sections thereof which encounter the same problems as bridge decks reqarding deterioration of inadequately prepared grooving. With regard to the description of the use of curbing structure for containing the side edges of poured concrete, it will be understood that any other suitable arrangement may be devised to contain the plastic concrete such as frames made of lumber or metal channel elements. Whatever arrangement is devised, the resultant containing structure serves as a facia member to the poured concrete. For forming the grooves, the drawings illustrate blades 50 having straight edges; however these edges may assume shapes such as curves or at two or more angularly related short straight edges.

From the foregoing, it will be appreciated that a method and apparatus has been described which will produce transverse grooves on a bridge deck or the like, such as airport runways, in a manner to prevent premature wear and tear of the grooves resulting from the accumulation of water at the terminal ends of the grooves. Furthermore, it will be apparent that the present invention accomplishes the production of grooves which are adapted to sustain long-time use and at a relatively low cost by forming the transverse grooves while concrete is in a plastic state, to form the grooves so that they taper into the concrete, and to bring the terminal ends of the grooves to a point where water in the grooves may be removed.

While the invention has been disclosed with reference to the structure disclosed, it is not confined to the details set forth but is intented to cover such modifications or changes as may come within the scope of the following claims.

What is claimed is:

1. An apparatus for forming grooves in plastic concrete deposited upon a bridge deck or the like comprising:

a support structure arranged for movement upon the deck or the like along the longitudinal axis thereof, a carriage arranged for reciprocal movement upon said support tranversely of the deck or the like and from one side thereof to the other, a cutter member associated with said carriage for movement with said carriage, said member having a plurality of blades in parallel orientation, and arranged for penetrating the surface of the plastic concrete whereby said movement of said carriage produces parallel grooves in the plastic concrete normal to the longitudinal axis of the deck or the like, and means connected to said carriage and said cutter member for permitting pivotal movement of said member about an axis transverse to the movement of said member whereby said cutter blades are adapted to assume the contour of the surface of the concrete.

* * * * *